United States Patent [19]

Stevenson

[11] 3,946,559

[45] Mar. 30, 1976

[54] HEAVE COMPENSATING DEVICES FOR MARINE USE

[75] Inventor: William David Stevenson, Edinburgh, Scotland

[73] Assignee: Brown Brothers & Company Limited, Edinburgh, Scotland

[22] Filed: Oct. 8, 1974

[21] Appl. No.: 513,115

[30] Foreign Application Priority Data

Oct. 9, 1973 United Kingdom ..... 47125/73

[52] U.S. Cl. ..... 60/413; 91/390; 175/24; 254/172

[51] Int. Cl.[2] ..... F15B 1/02

[58] Field of Search ..... 60/413, 907; 91/390; 175/567, 24, 27; 254/172; 61/46

[56] References Cited

UNITED STATES PATENTS

| | | | |
|---|---|---|---|
| 3,158,206 | 11/1964 | Kammerer | 60/907 X |
| 3,208,728 | 9/1965 | Parks | 254/172 |
| 3,653,635 | 4/1972 | Bates et al. | 254/172 |
| 3,687,205 | 8/1972 | Mori | 175/27 |
| 3,718,316 | 2/1973 | Larralde et al. | 254/172 |
| 3,793,835 | 2/1974 | Larralde | 60/907 X |
| 3,871,622 | 3/1975 | Larralde et al. | 254/172 |

*Primary Examiner*—Edgar W. Geoghegan
*Attorney, Agent, or Firm*—Christie, Parker & Hale

[57] ABSTRACT

A heave-compensating device particularly for floating oil drilling rigs incorporates a passive load-supporting system capable of being set to exert a chosen datum load-supporting force and an active force-modifying system operative when the force exerted by the passive load supporting system deviates from the chosen datum force to reduce the deviation. The passive load-supporting system may include a cylinder and piston assembly connected between a fixed support to which said system is connected and the load. The end of the cylinder adjacent the load is connected to a supply of liquid and to one end of a dashpot cylinder containing a piston, the other end of the dashpot cylinder being connected to a supply of compressed gas. The force-modifying system may incorporate a pressure sensor device in operative connection with both ends of the dashpot cylinder and controllingly connected to a pump alternatively connectible by valve means to opposite ends of a servo cylinder containing a piston connection to the piston of the dashpot cylinder.

11 Claims, 1 Drawing Figure

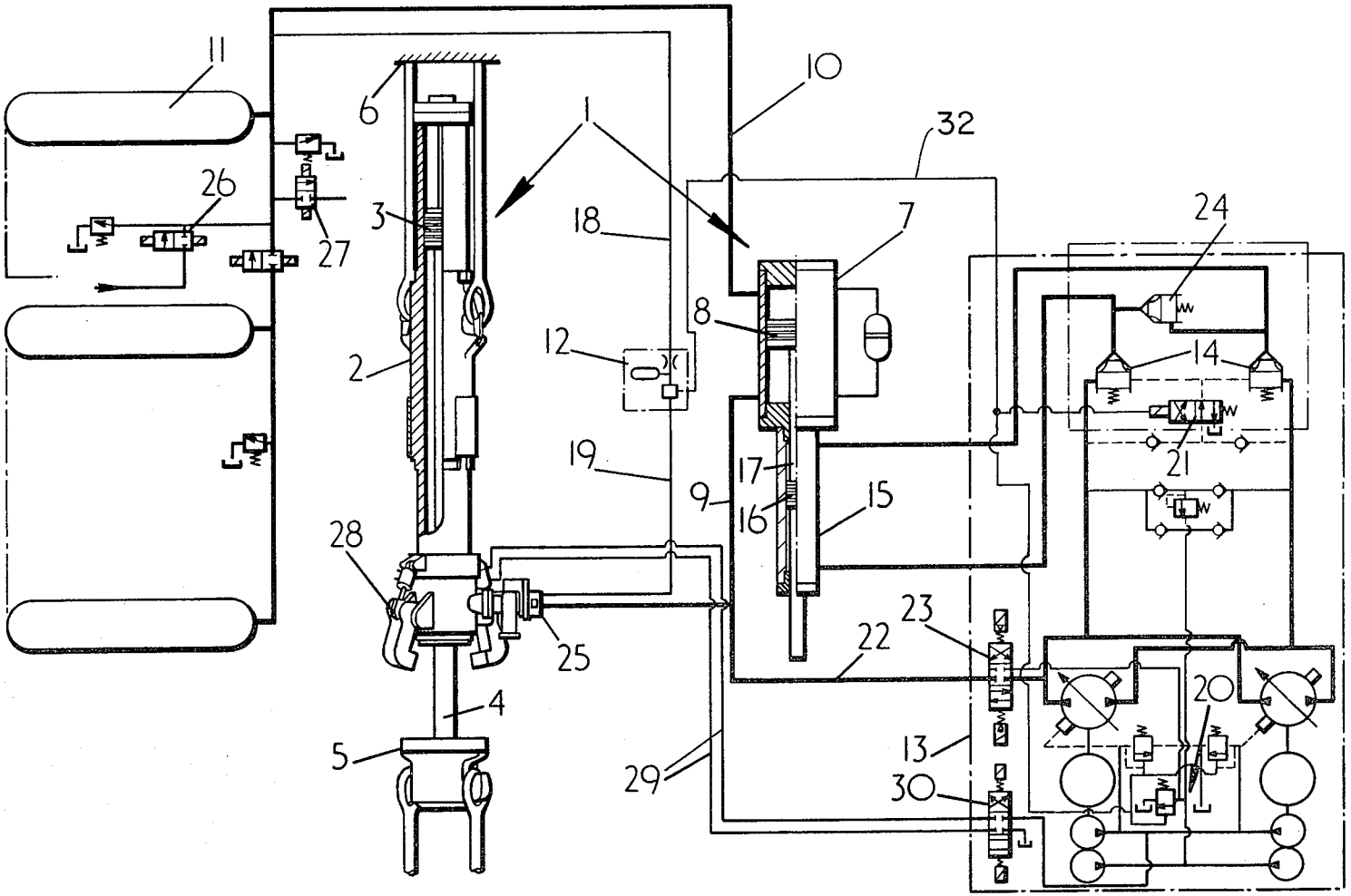
24
14
21
20
32
7
10
15
22
23
13
30
17
16
8
9
29
1
18
12
19
25
4
6
3
2
28
5
27
11
26

HEAVE COMPENSATING DEVICES FOR MARINE USE

This invention relates to heave compensating devices for marine use.

For performing certain operations on a sea bed conducted from a floating platform such as a ship or a floating drilling rig it is essential that the suspension system by which the device operating on the sea bed is attached to the platform should not be subjected to excessive stresses even during heaving of the floating platform. This requires that the upper end of the suspension system should be maintained at substantially the same height above the sea bed irrespective of heaving movement of the supporting platform. One such operation on the sea bed is a drilling operation for oil or gas. In such an operation the suspension system is a drill string and when drilling in deep water the weight of this drill string is considerable. The load consists of the combined weight of the drill string and the drilling head. If compensation for heaving of the supporting platform were not made the drill string would be alternately raised and lowered as the drilling platform rose and fell. In such a situation there is danger of breakage of the drill string and also of damage to the drilling head.

The previously known methods of taking care of this situation consist in forming the suspension system, which may be a drill string, with means permitting relative movement at some point in the length of the system or in incorporating a heave compensating device in the suspension gear by which the suspension system is suspended from the supporting platform.

For several reasons it is more convenient to provide a heave-compensating device. Heave-compensating devices as known heretofore are passive devices and incorporate what may be termed for convenience "pneumatic springs". A pneumatic spring is a fluid-charged device incorporating two cylinders both fitted with pistons, one of the pistons being connected to the load to be supported while the other is a free piston. Each cylinder contains liquid on one side of the piston and a gas usually air on the other. The liquid-containing ends of the cylinders are connected to one another.

In a construction employing a pneumatic spring any rise and fall of the suspension system caused by heaving of the supporting platform causes the piston connected to the load to move in its cylinder whereby to cause liquid to transfer from one cylinder to the other, movement of the piston in the other cylinder thus causing the air in the closed air supply system to fluctuate in pressure and provide a degree of compensation for the apparent change in weight of the load caused by rise and fall of the suspension point of the load. Such an installation works reasonably well in certain conditions but when the load to be supported is large and the permitted variation in lifting effort is low apparatus of this type requires to be so large and heavy that the cost of it becomes excessive.

It is an object of the present invention to provide a heave-compensating device which is capable of supporting a heavy load with a small variation in lifting effort under conditions of heave while requiring a device which for any given installation is much smaller than that previously known.

According to the invention a heave compensating device for maintaining a load suspended from a floating platform at a substantially constant level incorporates a passive load-supporting system including a resilient load-supporting connection attachable between a fixed support on the floating platform and the load to be supported, said resilient connection being capable of being set to exert a chosen datum load-supporting force when the load is a chosen datum distance below the floating platform, and an active force-modifying system operative to sense a deviation from said chosen datum load-supporting force and to operate to cause said deviation to tend towards zero.

The resilient load-supporting connection may be constituted by a heave-compensating cylinder and a piston slidable therein connected between the fixed support and the load, the end of the cylinder adjacent the load being arranged to be filled with an operating liquid and being in communication with one end of a dashpot cylinder containing a piston whereby to form a closed liquid system, the other end of the dashpot cylinder being open to a finite volume of compressed gas whereby to form a closed gas system.

The active force-modifying system may incorporate a sensor device in pressure-transmitting communication with the closed liquid system and with the closed gas system, the sensor device being operable to generate a control signal containing information relating to the pressures of the operating liquid and of the gas and also information relating to the sense of the difference between the two pressures, i.e. which is the higher, a double acting servo cylinder containing a piston coupled to the piston of the dashpot cylinder, liquid pump means connected by liquid transfer connections to the servo cylinder on opposite sides of its piston, control valve means intercalated in said liquid transfer connections and control means for the liquid pump means and the control valve means, said control means being connected to the sensor device to receive any signal issued thereby and thereupon to control operation of the liquid pump means and the settings of the control valve means.

The liquid pump means may be additionally connected into the closed liquid system by way of datum-setting valve means arranged to permit liquid to be introduced to and discharged from the closed liquid system. This arrangement permits the datum load-supporting force and/or the datum distance between the load and the floating platform to be changed at will.

Means may be provided for introducing air under pressure to and discharging air from the closed air system.

A locking valve may be incorporated in the connection between the heave-compensating cylinder and the dashpot cylinder, closure of said valve preventing transfer of liquid between the two cylinders and preventing movement of the piston of the heave-compensating cylinder in its cylinder.

The heave-compensating cylinder may incorporate a mechanical lock engageable with a chosen portion of the connection between the piston of the heave-compensating cylinder and the load. The mechanical lock may be arranged to be liquid-pressure operated and may then be operatively connected to the liquid pump means by way of a controlling valve.

A by-pass valve may be provided to connect opposite ends of the servo cylinder, the by-pass valve and the control valves being preferably so interlocked that when one of the control valves is open the by-pass valve is closed and when the by-pass valve is open both control valves are closed. This arrangement permits the active force-modifying system to be put out of action easily if for any reason this becomes necessary.

The lone drawing FIGURE schematically illustrates a system controlling the operation of heave compensating devices for marine use.

A practical embodiment of the invention is illustrated in the accompanying drawing in which 1 denotes generally a resilient load-supporting connection constituting a passive load-supporting system. In the resilient load-supporting connection 1 a heave-compensating cylinder 2 contains a piston 3 connected by a piston rod 4 to a load 5. Only the top end of the load 5 is shown because in the installation illustrated the complete load 5 consists of a drilling string and a drilling head at the lower end of the drilling string. The cylinder 2 is connected to a fixed support 6 on a floating platform (not illustrated). Numeral 7 denotes a dashpot cylinder containing a piston 8, the lower end of the cylinder 2 and one end of the cylinder 8 being connected by a liquid transfer pipe 9 the lower end of the cylinder 2, the pipe 9 and the connected end of the cylinder 7 being filled with liquid and constituting a closed liquid system. The other end of the cylinder 7 is connected by a pipe 10 to a bank of compressed air cylinders 11. The said other end of the cylinder 7, the pipe 10 and the air cylinders 11 constitute a closed air system.

The active force-modifying system is constituted by a sensor device 12, a liquid pump means 13, control valve means 14 and a servo cylinder 15 containing a piston 16 coupled by a piston rod 17 to the piston 8 of the dashpot cylinder 7. The sensor device 12 is connected by a pipe 18 to the closed gas system and by a pipe 19 to the closed liquid system and is operatively connected by connection 32 to control means 20 and 21 controlling operation of the pump means 13 and the control valve means 14 respectively.

Numeral 22 denotes a pipe connecting the pump means 13 to the closed liquid system by way of a datum-setting valve 23 and numeral 24 denotes a by-pass valve arranged when opened to connect the opposite ends of the servo-cylinder 15 to one another. When the valve 24 is open both control valves 14 are closed and when one control valve 14 is open the by-pass valve 24 is closed. Numeral 25 denotes a locking valve arranged when closed to isolate the heave-compensating cylinder 2 from the dashpot cylinder 7. Numeral 26 and 27 denote valves for introducing and discharging air from the closed gas system.

Numeral 28 denotes a mechanical lock arranged to engage mechanically a convenient portion of the load the lock being liquid-pressure operated and is connected by way of pipes 29 and a controlling valve 30.

In practice, to prepare the heave-compensating device for use the device must be adjusted to the chosen datum conditions to suit the total load to be supported and the total length of the drill string below the floating platform. This is done by admitting liquid to or discharging liquid from the closed liquid system by operation of the datum-setting valve 23 and by operating the pumping means 13 as necessary. The pistons 3 and 8 are set in this way so that they are approximately midway along their respective cylinders when the floating platform is at its mean height above the sea floor and the desired load-supporting thrust is being exerted. The mean height of the floating platform is the position the platform would occupy in a flat calm.

When the platform starts heaving, on the upward heave, differential movement between the piston 3 and the cylinder 2 causes an increase in pressure in the liquid in the heave-compensating cylinder 2. If this fluid were trapped in the cylinder 2 the pressure of the liquid would increase until it was capable of sustaining the total weight of the load which would then be lifted in unison with the platform. However, some of the liquid in the cylinder 2 is displaced into the dashpot cylinder 7 where in moving the piston 8 it causes an increase in the pressure of the air in the closed air system. The tendency is therefore, for the system to attempt to achieve a load balance at a slightly increased liquid pressure.

The rise in pressure of the liquid is detected by the sensor device 12 the other input to which is the pressure of the air in the closed air system. A signal representing the difference between the two pressures and the sense of that difference (i.e. which is higher) is applied to the control means 20 of the liquid pump means 13.

Under the control of the control means 20 the delivery of the pump means 13 is altered and operating liquid is delivered to the underside (as seen in the illustration) of the piston 16 in the servo cylinder 15. In this way, the servo cylinder 15 assists the dashpot piston 8 to compress the air and hence restore the liquid pressure in the compensating cylinder to approximately the initial datum value.

On a downward heave, the sequence of events is similar but, in this case the liquid pressure in the heave-compensating cylinder 2 is maintained by flow from the dashpot cylinder 7 to the heave-compensating cylinder 2, that flow being induced by expansion of the air in the closed gas system and by assistance from the servo cylinder, liquid under pressure from the pump means 13 now being directed to the upper side of the piston 16, because the sensor device 12 has sensed the change in sense of the differential pressures acting on it and has reset the valves 14 accordingly.

The action, just described, of the automatic control system is continuous and independent of the relative positions of the piston and cylinder of the heave-compensating cylinder 2.

In practice, the pressure of the liquid in the heave-compensating cylinder 2 cannot be maintained perfectly constant at the initial level (for one thing, a change in pressure is required before the servo-cylinder can be brought into operation). However the system is able to keep the load variation within $\pm$ 0.5% of the nominal and this is more than sufficient for all practical purposes.

What is claimed is:

1. A heave compensating device for maintaining a load suspended from a floating platform at a substantially constant level incorporating a pneumatically biased passive load-supporting system including a resilient load-supporting bidirectionally movable connection attachable between a fixed support on a floating platform and the load to be supported, said passive system being capable of being set to exert continuously on said connection a chosen datum load-supporting force, and an active force modifying hydraulic system operative to sense a deviation from said chosen datum load-supporting force to operate to cause said deviation to tend towards zero, the passive system including a first piston disposed in a first cylinder and having one face of the piston exposed to a working fluid of the resilient connection and the other face pneumatically loaded for exerting on the connection the chosen datum force, the active system including in a second cylinder a second piston connected to the first piston and having opposite faces, and means for applying a hydraulic fluid to an appropriate one of the second piston faces as determined by the nature of a deviation sensed in the chosen datum force.

2. A device as claimed in claim 1 in which the resilient load-supporting connection is constituted by a heave compensating cylinder and a piston slidable therein connected between the fixed support and load, the end of the cylinder adjacent the load being arranged to be filled with said working fluid and being in communication with the one of the first piston whereby to form a closed fluid system.

3. A heave compensating device for maintaining a load suspended from a floating platform at a substantially constant level incorporating a passive load-supporting system including a resilient load-supporting connection attachable between a fixed support on the floating platform and the load to be supported, said resilient connection being capable of being set to exert a chosen datum load-supporting force, and an active force-modifying system operative to sense a deviation from said chosen datum load-supporting force and to operate to cause said deviation to tend towards zero, the resilient load-supporting connection including a closed liquid system and the passive system including a closed gas system operatively related to each other by the opposite faces of a dashpot piston, the active force-modifying system incorporating a sensor device in pressure transmitting communication with the closed liquid system and with the closed gas system, the sensor device being operable to generate a control signal containing information relating to the pressures of the liquid in the closed liquid system and of the gas and also information relating to the sense of the difference between the two pressures, i.e., which is the higher, a double-acting servo cylinder containing a piston coupled to the dashpot piston, liquid pump means connected by liquid transfer connections to the servo cylinder on opposite sides of its piston, control valve means intercalated in said liquid transfer connections and control means for the liquid pump means and the control valve means, said control means being connected to the sensor device to receive any signal issued thereby and thereupon to control operation of the liquid pump means and the settings of the control valve means.

4. A device as claimed in claim 3 in which the liquid pump means is additionally connected into the closed liquid system by way of datum setting valve means arranged to permit liquid to be introduced to and discharged from the closed liquid system.

5. A device as claimed in claim 2 including a locking valve incorporated in the connection between the heave-compensating cylinder and the first cylinder, closure of said valve preventing transfer of liquid between the two cylinders and preventing movement of the piston of the heave-compensating cylinder in its cylinder.

6. A heave compensating device for maintaining a load suspended from a floating platform at a substantially constant level incorporating a passive load-supporting system including a resilient load-supporting connection attachable between a fixed support on the floating platform and the load to be supported, said resilient connection being capable of being set to exert a chosen datum load-supporting force, and an active force-modifying system operative to sense a deviation from chosen datum load-supporting force and to operate to cause said deviation to tend towards zero, the resilient load-supporting connection being constituted by a heave compensating cylinder and a piston slidable therein connected between the fixed support and the load, the end of the cylinder adjacent the load being arranged to be filled with an operating liquid and being in communication with one end of a first piston disposed in a first cylinder whereby to form a closed liquid system, the passive system including a closed gas system communicating with the opposite end of the first piston, and a locking valve incorporated in the connection between the heave compensating cylinder and the first cylinder, closure of said valve preventing transfer of liquid between the two cylinders and preventing movement of the piston in the heave compensating cylinder.

7. A device as claimed in claim 1 in which the resilient load-supporting connection includes a closed liquid system and the passive system includes a closed gas system operatively related to each other by the opposite faces of a piston slidable in a cylinder, and including a locking valve incorporated in the closed liquid system, closure of the locking valve preventing transfer of liquid within the closed liquid system to and from the piston for effectively eliminating resilience in the load-supporting connection.

8. A heave compensating device for maintaining a load suspended from a floating platform at a substantially constant level incorporating a passive load-supporting system including a resilient load-supporting connection attachable between a fixed support on the floating platform and the load to be supported, said resilient connection being capable of being set to exert a chosen datum load-supporting force, and an active force-modifying system operative to sense a deviation from said chosen datum load-supporting force and to operate to cause said deviation to tend toward zero, the resilient load-supporting connection being constituted by a heave compensating cylinder and a piston slidable therein connected between the fixed support and the load, the heave compensating cylinder incorporating a mechanical lock engageable with a chosen portion of the connection between the piston of the heave compensating cylinder and the load.

9. A device as claimed in claim 8 in which the mechanical lock is arranged to be liquid pressure operated and is operatively connected to the liquid pump means by way of a controlling valve.

10. A device as claimed in claim 3 in which a by-pass valve is provided to connect opposite ends of the servo cylinder.

11. A device as claimed in claim 10 in which the by-pass valve and the control valves are so interlocked that when one of the control valves is open the by-pass valve is closed and when the by-pass valve is open both control valves are closed.

* * * * *

UNITED STATES PATENT OFFICE

CERTIFICATE OF CORRECTION

PATENT NO. : 3,946,559

DATED : March 30, 1976

INVENTOR(S) : William David Stevenson

It is certified that error appears in the above-identified patent and that said Letters Patent are hereby corrected as shown below:

Column 3, line 48, for "Numeral" read -- Numerals --.

Column 5, line 15, Claim 2, after "one" insert -- end --.

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*